United States Patent [19]

Wilhelm

[11] 4,387,521

[45] Jun. 14, 1983

[54] ALPHA NUMERIC CHARACTER ARRANGEMENT

[76] Inventor: Donald C. Wilhelm, 110 Clarion Dr., Whitesboro, N.Y. 13492

[21] Appl. No.: 285,479

[22] Filed: Jul. 21, 1981

[51] Int. Cl.[3] ..... G09D 3/00

[52] U.S. Cl. ..... 40/107; 40/596; 40/615; 434/96

[58] Field of Search ..... 40/584, 596, 107; 434/96

[56] References Cited

U.S. PATENT DOCUMENTS

| | | | |
|---|---|---|---|
| D. 127,516 | 5/1941 | Chernow | D64/12 |
| D. 200,078 | 1/1965 | Miller et al. | D64/12 |
| D. 212,242 | 9/1968 | Paulus | D34/15 |
| 940,316 | 11/1909 | Holt | 40/596 |
| 1,125,423 | 1/1915 | Wiley | 40/447 X |
| 1,700,762 | 2/1929 | Fischer | 40/107 X |
| 2,080,652 | 5/1937 | Cook et al. | 40/158 R X |
| 2,327,718 | 8/1943 | Kassler | 273/157 R X |
| 2,493,697 | 1/1950 | Raczkowski | 273/157 R |
| 2,725,234 | 11/1955 | Coble et al. | 273/157 R |
| 3,215,435 | 11/1965 | Rheingruber | 273/143 |
| 3,564,741 | 2/1971 | Kahre et al. | 40/107 |
| 3,800,442 | 4/1974 | Petrocelli | 434/96 |

FOREIGN PATENT DOCUMENTS

| | | | |
|---|---|---|---|
| 37177 | 5/1906 | Switzerland | 40/596 |
| 144537 | 6/1920 | United Kingdom | 40/107 |

*Primary Examiner*—Gene Mancene
*Assistant Examiner*—Wenceslao J. Contreras
*Attorney, Agent, or Firm*—Brady, O'Boyle & Gates

[57] ABSTRACT

An arrangement of alpha numeric character sets comprising a plurality of alpha numeric characters of graduated sizes graphically layered in two or three dimensional form. The characters are arranged in a superimposed fashion with the sizes of the characters uniformly graduating in size as one views each set of characters. The characters thus arranged appear to be arranged in a stacked form over a common center point or axis. Such an arrangement is particularly adapted to provide a representation of a calendar date but can, when desirable, be utilized to spell a word such as a person's name.

15 Claims, 12 Drawing Figures

FIG.1
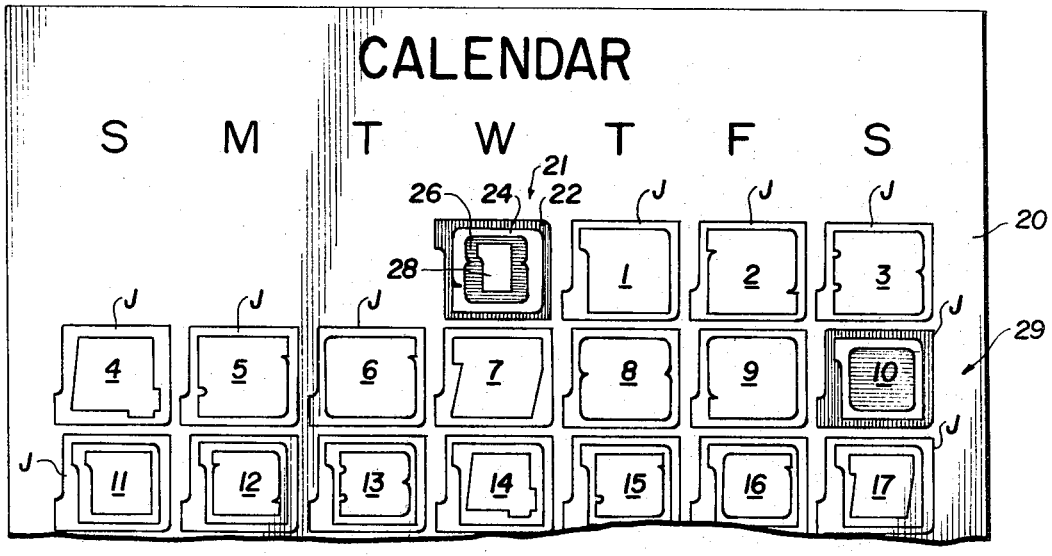
FIG.2
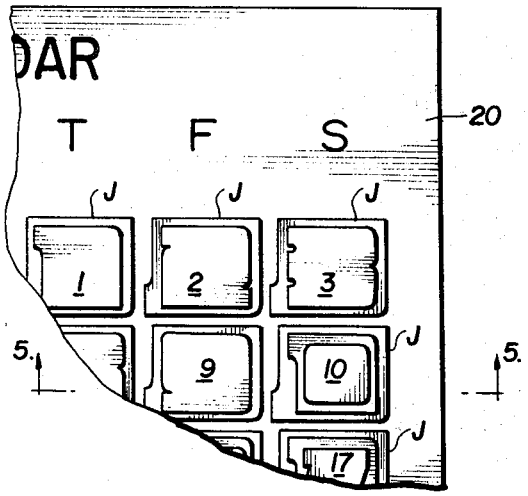
FIG.3
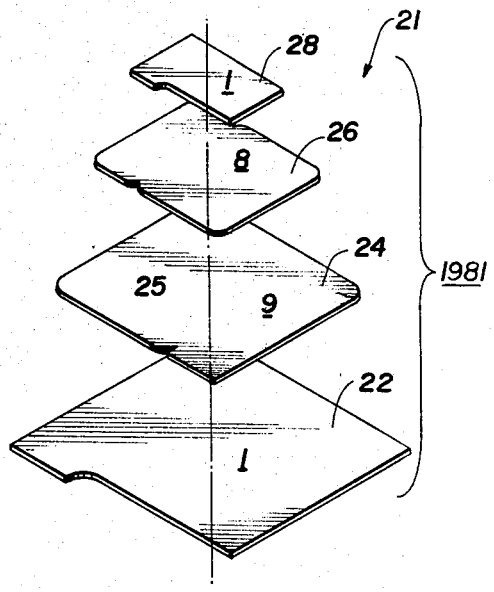
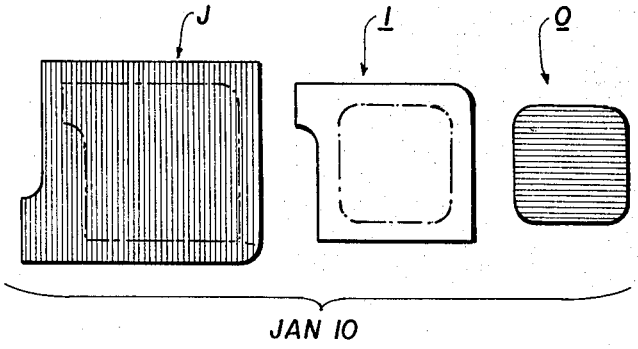
FIG.4

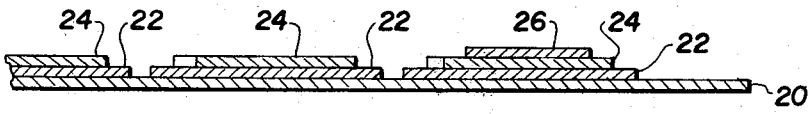
FIG.5
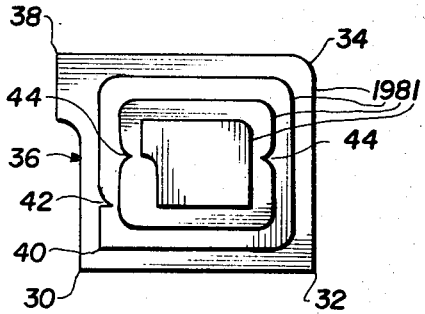
FIG.6
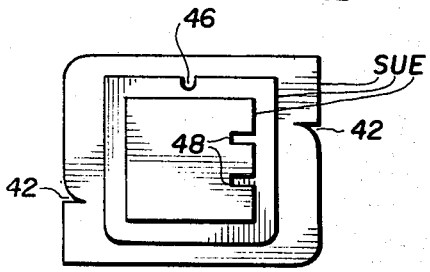
FIG.7
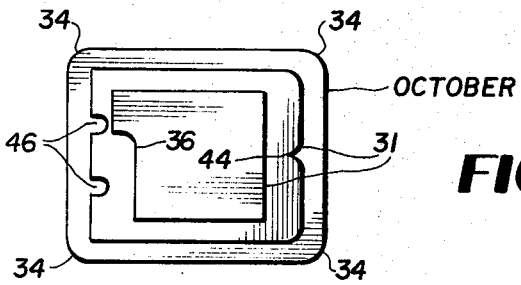
FIG.8
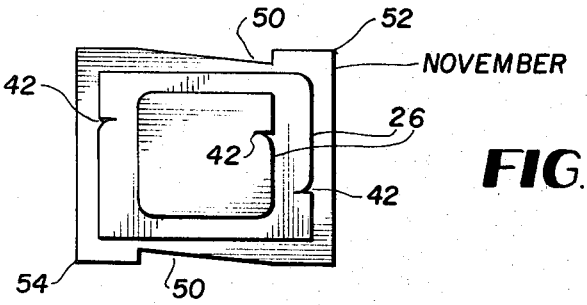
FIG.9
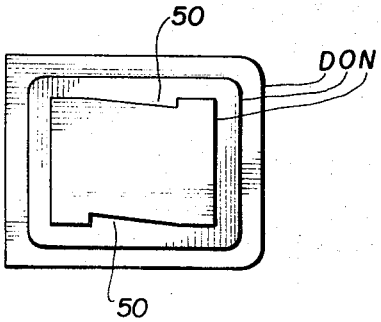
FIG.10
FIG.11
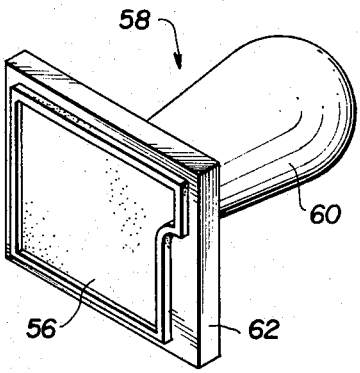
FIG.12
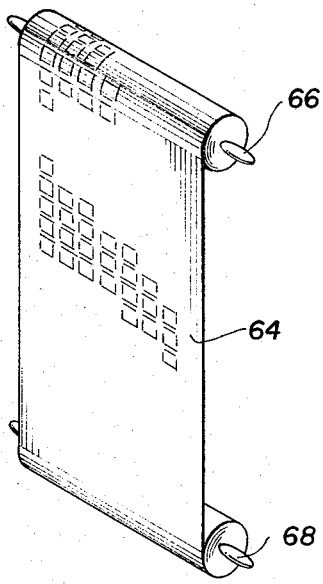

ALPHA NUMERIC CHARACTER ARRANGEMENT

BACKGROUND OF THE INVENTION

This invention relates generally to alpha numeric displays and more particularly to a set of alpha numeric characters which are arranged in mutual registration one on top of the other to convey intelligence.

While there are known types of graphic arts apparatus consisting of overlays or multi-layer compositions to form various typer of pictures or designs, they are not directed to graphic arts apparatus which is adapted to be read in such a manner that each individual layer must be read in sequence in order to gain an understanding of the particular message being portrayed.

SUMMARY

Accordingly, it is an object of the present invention to provide an improvement in the graphic arts.

It is another object of the present invention to provide an improvement in alpha numeric displays.

Yet another object of the present invention is to provide a graphically layered alpha numeric display for conveying intelligence.

Still another object of the present invention is to provide a graphically layered alpha numeric display for providing an indication of a calendar date or the spelling of a word.

These and other objects are provided in accordance with a graphic arts arrangement of alpha numeric character sets comprising the combination of a plurality of alpha numeric characters of graduated sizes and selectively modified profiles which are graphically layered and arranged in a superimposed fashion on a reference plane such that a mutual registration exists along a central axis with the sizes of the characters uniformly graduating as the characters are perceived with respect to the reference plane. The characters individually exhibit a continuous planar surface devoid of any openings and the outside edges thereof are curved, notched, and otherwise varied to abstractly describe a predetermined letter or number.

BRIEF DESCRIPTION OF THE DRAWINGS

FIG. 1 is a partial planar view generally illustrative of an embodiment of the subject invention in the form of a calendar;

FIG. 2 is a partial cut-away view further illustrative of the embodiment shown in FIG. 1;

FIG. 3 is an exploded view of one set of alpha numeric characters utilized in the calendar shown in FIG. 1 for indicating the year 1981;

FIG. 4 is a graphical unlayered illustration of one set of alpha numeric characters shown in FIG. 1 for indicating the data January 10;

FIG. 5 is a cross sectional view of the embodiment shown in FIG. 2 taken along the lines 5—5 thereof;

FIGS. 6 through 10 are five illustrations of various other calendar dates and names of individuals;

FIG. 11 is a perspective view of a rubber stamp adapted to provide the character in the form of a numeral 1; and FIG. 12 is an illustration of a paper scroll which is imprinted with alpha numeric indicia in accordance with the subject invention to be utilized several ways including being used as a calendar.

DESCRIPTION OF A PREFERRED EMBODIMENT

Referring now to the drawings wherein like numerals refer to like parts throughout, reference will first be made to FIG. 1 wherein there is shown a preferred embodiment of the invention which comprises a calendar configured by means of an arrangement of alpha numeric characters which are superimposed in graphically layered composite sets. In addition to a year indication the character sets are arranged in columns and rows so that they relate to days and weeks of a particular calendar year. More particularly, reference numeral 20 denotes a reference plane on which is formed a plurality of character sets, the first of which 21 is comprised of four characters 22, 24, 26 and 28 which indicate the year 1981 as shown in FIG. 3. The characters are uniformly graduated in size with innermost character 22 being the largest while the outermost character 28 is the smallest. The characters are arranged in mutual registration on a common central vertical axis 25 such that the profile or outside edge of each character while having a continuous planar surface devoid of any openings therein is distinguishable with respect to the others of the same set so that for example the year 1981 can be readily identified by noting that the profile of the character 22 denotes the numeral 1, the profile of the character 24 is indicative of the number 9, the profile of character 26 denotes the number 8 and the character 28 has a profile which indicates the number 1. The characters 22 and 28 are identical with the exception of size. The days of the month are implemented in a like fashion as will be explained.

In order to make the characters more readily identifiable, the alpha numeric characters are preferably but not necessarily colored, with alternate characters, for example, characters 24 and 28 having a different color relative to the color of the adjoining characters 22 and 26. Where, for example, characters 24 and 28 are to be colored white, the character 22 is colored red, while the intermediate character 26 is colored blue. Alternatively, the characters 22 and 24 have the same color; however, any desirable combination of colors can be utilized as long as the shape or profile of the individual characters is highlighted, particularly insofar as immediately adjacent characters are concerned. Further, when desirable, all of the characters can be of the same color.

With respect to the manner in which the individual alpha numeric characters are formed, the particular numbers and/or letters which are utilized to form any one character set, as noted above, are devoid of any interior spaces, which spaces are commonly found in such numbers as 6, 8, 9 and 0 and the letters A, O, and D. Accordingly, the outer or outside edges are curved, notched, angularly indented and otherwise varied to describe in a relatively abstract fashion, a particular letter or number. The alpha numeric characters, moreover, are block-like in shape in that their lateral dimension is substantially equal to or greater than their lengthwise dimension and thus each composite set exhibits a generally rectangularly shaped appearance.

With respect to the specific calendar implementation of the invention as shown in FIG. 1, a particular month of the year is designated by the repeated use of a particular letter, for example, the character J for January which comprises the innermost character of a set having one or more numerals layered thereon. As the dates increase, layered numbers 1, 2, 3 . . . 30, 31 are formed thereon one on top of the other. Reference numeral 29, for example, is designative of the calendar date January 10, 1981 and includes the letter J, an intermediate number 1 and an outer number 0. This arrangement is further illustrated in FIG. 4 with the three characters J, 1 and 0 being located side by side but with their mutual layered relationship being indicated by the phantom lines as shown. The arrangement of characters as shown in FIG. 4 is furthermore intended to illustrate that the three individual characters J, 1 and 0 are of differing colors, for example, red, white and blue in order to highlight the profile of the individual characters. While three colors are shown in FIG. 4, when desirable the innermost and outermost characters J and 0, for example, could be of the same color, while the intermediate character 1 is of a different color. In order for a complete calendar to be implemented, the character units required would include eight large upper case letters J, F, M, A, S, O, N, D while nine medium sized numbers for the numbers 1 through 9 would be required as well as 10 small sized numbers for the numbers 1, 2, . . . 9, 0.

Because each data forms an abstract block design which when viewed as a whole is pleasing to the eye, a distinctive pattern emerges resembling a work of art particularly when portrayed in color. Accordingly, the resultant effect is one which not only provides a calendar, but also an artistic pattern is provided which can be put to any number of uses depending upon the taste and ingenuity of the user.

As shown in FIG. 3, the character set for the year 1981 is shown comprising four discrete layers 22, 24, 26 and 28 superimposed on a common center line 25; however, this can be in the form of print to provide a two dimensional format on a web or roll of sheet stock which makes up the reference plane 20 or it can take a three dimensional aspect as suggested in FIGS. 2 and 5. As shown in FIG. 5 which is a cross section of FIG. 2 taken along the lines 5—5, depending upon the thicknesses of the respective layers 22, 24, 26, a three dimensional configuration is provided where the layers 22, 24 and 26 make up the alpha numeric character sets for the dates January 9 and 10 while the layer 20 comprises a base layer. In any event a graphically layered visual impression is provided.

Referring now to FIGS. 6 through 10, shown therein are several examples of superimposed alpha numeric characters in accordance with the subject invention which is adapted to indicate a particular number, year, date or word. FIG. 6 is a repetition of the character set for the year 1981 and which has previously been referred to as the character set 21 shown in FIGS. 1 and 3. What is significant is the uniform size graduation between adjacent layers and the manner in which the edges are modified to form the particular number or letter desired. The number 1, for example, is formed by squared lower corners 30 and 32 while the upper right hand corner 34 is curved and with the left hand edge 36 indented just below the squared upper left hand corner 38. The numeral 9 is formed by a character whose lower left hand corner 40 is square while the three remaining corners are curved but with a saw-tooth type notch 42 being formed in the lower portion of the left hand edge. The character for the numeral 8 is formed by a character having four rounded corners with a pair of curved notches 44 formed in the left and right hand edges.

With reference to FIG. 7, the character configuration shown therein spells the name "SUE" in which letter S comprises the innermost layer, the letter U is the intermediate layer and the letter E is the third or outermost layer. It can be seen that each of the letters include notches in their side edges with the difference being the type of notches implemented. The letter S includes a pair of saw-tooth type notches 42 in opposing side edges while the letter U includes a rounded or circular type notch 46 in its upper edge, while the letter E includes a pair of square notches 48 in the right side edge.

Insofar as FIG. 8 is concerned, the data October 31 is shown with the underlying layer being comprised of a letter O which is a character rectangular in shape but having four rounded corners 34. The intermediate layer describes the number 3 which is comprised of a character having a curved notch 44 in the right side edge while two rounded notches 46 appear in the opposing side edge.

With respect to FIG. 9, it illustrates the character set for the data November 26 and is comprised of an underlying layer formed in the letter N which consists of a character whose upper and lower edges include angulated indentations 50 toward the diagonal corners 52 and 54. Insofar as the numbers are concerned, they are comprised of characters having square and rounded corners as well as saw-tooth type notches 42 in the appropriate side edges to provide the required graphical representation of the numbers 2 and 6. With respect to FIG. 10, it is intended to illustrate the name "DON". It can be seen that the outermost letter N is of the same identical shape as the relatively larger version of the letter N shown in FIG. 9. Thus in all instances whether a particular layer is formed into a letter or a number, the only change that is made is in the relative size of the character.

The arrangement of the character sets finds itself adapted to a variety of different applications and formats. The calendar adaptation shown in FIGS. 1 and 2 can, when desirable, be implemented in a notebook of any desired size for noting important dates. It could also be reduced in size for a wallet or billfold or even used as a bookmark. Because of the ornamental effect provided by the arrangement of characters in rows and columns, it is adapted to be graphically applied to a wall hanging of any desired length or it could be utilized in a two sided banner which is adapted to hang freely like a flag. Also the graphic rendition of the superimposed characters can be included in a coloring book for children. When desirable, selective characters of various sizes can be formed on a respective stamp face portion of a rubber stamp 58 including a handle 60 and base 62 as shown in FIG. 11 where if a calendar is desired to be formed would require twenty seven stamps for one complete year. As shown in FIG. 12, the inventive concept can further be applied via printing to a scroll comprised of an elongated sheet or web 64 which is wound between a pair of opposing rollers 66 and 68. While configurations implemented by means of the apparatus shown in FIGS. 11 and 12 provides a two dimensional format, as noted with respect to FIGS. 3 and 5, depending upon the thicknesses of the various layers, a three dimensional effect can be achieved which adapts itself, for example, to a sculpture or relief fabricated from a variety of materials. A floor mounted, free-standing kiosk, not shown, could when desirable include an implementation of the subject invention in either a two dimensional or three dimensional form. And yet another application of the invention would be where it is formed into a kit whereby an arts-crafts person would construct any desired arrangement of letters and/or numbers in a specific type of media which includes wood, paper, cardboard, plastic, felt, metal, etc. It even lends itself to a rub-on "transfer type" kit.

Thus it can be seen that while a calendar finds a particular application for the arrangement of alpha numeric characters and comprises a preferred embodiment thereof, it should be understood that the foregoing detailed description has been made by way of illustration and not limitation and accordingly all modifications, alterations and changes coming within the spirit and scope of the invention as set forth in the appended claims is meant to be included.

I claim as my invention:

1. An indicia arrangement for alpha numeric displays including a calendar date, comprising plural visually superposed substantially block type indicia characters in coaxial relationship, each being of graduated and progressively diminishing sizes uniformly, bottom-to-top, in relation to a reference plane for the indicia arrangement, the individual characters in said arrangement differing in marginal edge profile by being selectively curved, notched and angularly indented to form a respective letter or number and each successive character from the largest character upwardly in the arrangement covering and concealing a central area portion of the next underlying indicia character, whereby the edge profiles of all of the characters in the arrangement coact to produce, in a relatively abstract fashion, a readable sequence of indicia characters when read from bottom-to-top in relation to said reference plane.

2. The graphic arts arrangement as defined by claim 1 wherein said each character respectively includes lateral and lengthwise dimensions and wherein the lateral dimension is substantially equal to or greater than the lengthwise dimension.

3. The graphic arts arrangement as defined by claim 1 wherein each set of alpha numeric characters form a composite configuration which is generally rectangular in shape.

4. The graphic arts arrangement as defined by claim 1 wherein characters of each set of alpha numeric characters are colored.

5. The graphic arts arrangement as defined by claim 1 wherein the plurality of alpha numeric characters of each set are formed in a composite two dimensional arrangement on said reference plane.

6. The graphic arts arrangement as defined by claim 1 wherein each character of a set is of a substantial thickness to form a three dimensional arrangement on said reference plane.

7. The graphic arts arrangement as defined by claim 1 wherein plural sets of said alpha numeric characters are arranged in rows and columns.

8. The graphic arts arrangement as defined by claim 7 wherein said rows and columns define a calendar arrangement wherein the columns indicate days of the week and the rows indicate the weeks of a month.

9. The graphic arts arrangement as defined by claim 8 wherein said plural sets of alpha numeric characters in said calendar arrangement are arranged in twelve sub sets with each sub set having a common letter indicative of a particular month of the year.

10. The graphic arts arrangement as defined by claim 9 wherein said common letter of each sub set comprises the largest sized character of each character set.

11. The graphic arts arrangement as defined by claim 10 wherein the alpha numeric characters of each character set are alternately colored in at least two colors for providing a color contrast between adjacent characters.

12. The graphic arts arrangement as defined by claim 10 and additionally including a four number character set indicative of a particular year.

13. The graphic arts arrangement as defined by claim 4 wherein alternate characters of each set of alpha numeric characters are selectively colored to provide a contrasting visual configuration whereby each character may be more easily identified and the set understood as a whole.

14. The graphic arts arrangement as defined by claim 4 wherein the alpha numeric characters of each character set are alternately colored in at least two colors for providing a color contrast between adjacent characters.

15. The graphic arts arrangement as defined by claim 4 wherein all of the alpha numeric characters of each character set are of the same color.

* * * * *